US007726939B2

(12) United States Patent
Lee et al.

(10) Patent No.: US 7,726,939 B2
(45) **Date of Patent: *Jun. 1, 2010**

(54) HEAT-DISSIPATING FAN AND ITS HOUSING

(75) Inventors: Chin-Hung Lee, Taoyuan (TW); Shun-Chen Chang, Taoyuan (TW); Kuo-Cheng Lin, Taoyuan (TW); Wen-Shi Huang, Taoyuan (TW); Hsiou-Chen Chang, Taoyuan (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 143 days.

This patent is subject to a terminal disclaimer.

(21) Appl. No.: 11/822,500

(22) Filed: Jul. 6, 2007

(65) Prior Publication Data

US 2007/0253814 A1 Nov. 1, 2007

Related U.S. Application Data

(63) Continuation of application No. 11/001,027, filed on Dec. 2, 2004, now Pat. No. 7,275,911.

(51) Int. Cl.
*F04D 29/54* (2006.01)

(52) U.S. Cl. ..... 415/211.2; 415/220; 415/221

(58) Field of Classification Search ..... 415/66, 415/191, 211.2, 220, 221, 915; 416/198 R, 416/223, 243
See application file for complete search history.

(56) References Cited

U.S. PATENT DOCUMENTS

| | | | | |
|---|---|---|---|---|
| 2,397,170 | A | 3/1946 | Jenkins | |
| 3,995,970 | A | 12/1976 | Nobuyuki et al. | |
| 4,482,302 | A * | 11/1984 | Grignon | 417/354 |
| 5,028,216 | A * | 7/1991 | Harmsen et al. | 417/354 |
| 5,650,678 | A * | 7/1997 | Yokozawa et al. | 310/90 |
| 5,940,268 | A | 8/1999 | Miyahara et al. | |
| 6,045,327 | A | 4/2000 | Amr | |
| 6,547,540 | B1 | 4/2003 | Horng et al. | |
| 6,799,942 | B1 * | 10/2004 | Tzeng et al. | 415/61 |
| 6,926,497 | B2 * | 8/2005 | Lin et al. | 415/213.1 |
| 7,040,862 | B2 | 5/2006 | Otsuka et al. | |
| 7,052,236 | B2 | 5/2006 | Chang et al. | |
| 7,156,611 | B2 * | 1/2007 | Oosawa et al. | 415/68 |
| 7,275,911 | B2 * | 10/2007 | Lee et al. | 415/211.2 |
| 2002/0094271 | A1 | 7/2002 | Yeuan et al. | |
| 2005/0106026 | A1 | 5/2005 | Oosawa et al. | |

FOREIGN PATENT DOCUMENTS

| | | |
|---|---|---|
| CN | 2504417 | 8/2002 |
| CN | 1369649 | 9/2002 |

(Continued)

*Primary Examiner*—Ninh H Nguyen
(74) *Attorney, Agent, or Firm*—Birch, Stewart, Kolasch & Birch, LLP

(57) ABSTRACT

A heat-dissipating fan with an upward air-guiding member is provided. The heat-dissipating fan includes a housing, an impeller having a hub and a plurality of blades disposed around the hub, a base disposed inside the housing for supporting the impeller thereon, and an air-guiding member disposed between the base and the housing, wherein the air-guiding member has at least one inclined edge on the windward side or its opposite side relative to the horizontal line perpendicular to the axis of the heat-dissipating fan.

19 Claims, 9 Drawing Sheets

FOREIGN PATENT DOCUMENTS

| | | | |
|---|---|---|---|
| DE | 3528748 | | 3/1986 |
| DE | 201 15 410 | | 1/2002 |
| DE | 102 04 830 | A1 | 6/2003 |
| GB | 584657 | A | 1/1947 |
| GB | 983469 | A | 2/1965 |
| JP | 3083969 | A | 4/1991 |
| JP | 8028491 | A | 1/1996 |
| JP | 2000-110772 | A | 4/2000 |
| JP | 2000-205194 | A | 7/2000 |
| JP | 2004-132300 | | 4/2004 |

* cited by examiner

HEAT-DISSIPATING FAN AND ITS HOUSING

CROSS-REFERENCE PARAGRAPH

This application is a Continuation of application Ser. No. 11/001,027, filed on Dec. 2, 2004 now U.S. Pat. No. 7,275,911, which claims priority to Taiwan Patent No. 093125858, filed on Aug. 27, 2004, the entire content of which are hereby incorporated by reference.

FIELD OF THE INVENTION

The present invention is related to a heat-dissipating fan and its housing, and especially to an axial-flow fan and its housing.

BACKGROUND OF THE INVENTION

In a normal electronic product such as a computer, electronic devices will generate a lot of heat during operation. If the electronic devices are continuously operated at high temperature, they are easily damaged. Thus, to prevent such a damage, a heat-dissipating fan is normally disposed in the electronic product to dissipate heat to the surrounding.

Please refer to FIG. 1 which shows a conventional axial-flow fan for the computer. The conventional axial-flow fan mainly includes a housing 10, a motor 11 and an impeller 12 with a plurality of blades. The housing 10 includes a base 14 for supporting the motor 11 and has a plurality of ribs or stationary blades 13 at the air outlet side of the axial-flow fan. When the motor 11 drives the impeller 12 to rotate, the blades 121 will discharge the airflow from the air outlet side of the axial-flow fan. However, each upper edge of the ribs or stationary blades 13 is shaped in a horizontal form so that the airflow generated by the blades 121 will arrive at the ribs or stationary blades 13 at the same time. Furthermore, the distance H between the lower edge of the blade 121 and the upper edge of the rib or stationary blade 13 is relatively small such that it will cause a lot of noise in a very short time as the airflow passes therethrough and worsen the sound, resulting from the air turbulence.

Thus, it is desirable to reduce the air turbulence noise of the axial-flow fan generated while rotating.

SUMMARY OF THE INVENTION

The present invention provides a heat-dissipating fan including a first housing, a first impeller having a hub and a plurality of blades arranged around the hub, a base disposed inside the housing for supporting the first impeller, and an air-guiding member disposed between the housing and the base, and having a first edge with a first inclined angle relative to a line perpendicular to an axis of the heat-dissipating fan.

The first edge of the air-guiding member is located on a windward side of the heat-dissipating fan and the first inclined angle is preferably ranged from 3° to 45°.

In addition, the air-guiding member has a second edge located opposite to the first edge and having a second inclined angle relative to the line. The second inclined angle is preferably ranged from 3° to 45°. The first inclined angle can be greater than, equal to or less than the second inclined angle.

In one embodiment, at least one blade of the impeller has an edge with a third inclined angle relative to the line, and the third inclined angle is preferably ranged from 3° to 45°. At least one blade of the impeller can also have an opposite edge with a fourth inclined angle relative to the line, and the fourth inclined angle is preferably ranged from 3° to 45°, wherein the third inclined angle can be greater than, equal to or less than the fourth inclined angle.

The air-guiding member is positioned on an air inlet or an air outlet of the heat-dissipating fan. The air-guiding member has one end connected to the base and the other end free extending toward a direction of an inner wall of the first housing. Or, the air-guiding member has one end connected to an inner wall of the first housing and the other end free extending toward a direction of the base. Alternatively, the air-guiding member is composed of a plurality of ribs or stationary blades, a portion of which respectively have one end connected to the base and the other end free extending toward a direction of an inner wall of the first housing, and other portion of which respectively have one end connected to an inner wall of the first housing and the other end free extending toward a direction of the base. The number of ribs or stationary blades is preferably unequal to that of the blades of the first impeller.

Preferably, the air-guiding member has a gradually increasing or decreasing cross-section area from the base toward the first housing. Or, the air-guiding member has a central part with a thickness relatively greater or smaller than those of two opposite ends thereof.

Preferably, the air-guiding member has a stick, curved, trapezoid, or wing-like cross-section shape.

Preferably, the blades have a curved or wing-like cross-section with an inclined angle ranging from 15° to 60° relative to the axis of the heat-dissipating fan.

On the other hand, the heat-dissipating fan further includes a metallic shell telescoped inside the hub and having a plurality of openings, wherein the metallic shell has a stepped structure formed on a periphery of a top portion of the metallic shell.

Moreover, the heat-dissipating fan further includes a driving device mounted inside the hub for driving the first impeller.

The hub has a plurality of through holes formed on a top portion thereof, and has a inclined or arc structure formed on a periphery of a top portion thereof, and a vertical portion. The blades of the first impeller respectively have an upper inner edge positioned at an interface between the inclined or arc structure and the vertical portion, and a lower inner edge relatively higher than a bottom end of the vertical portion.

Further, the first housing has an outwardly expanding part located on an air inlet side or an air outlet side of the heat-dissipating fan for increasing an air intake or discharge. The first housing further includes a cylindrical part and the air-guiding member has one end connected to the base and the other end connected to an inner wall of the cylindrical part. Alternatively, the air-guiding member has one end connected to the base and the other end connected to inner walls of the cylindrical part and the outwardly expanding part simultaneously.

Preferably, the base, the air-guiding member and the first housing are integrally formed as a monolith piece by injection molding.

In another embodiment, the heat-dissipating fan further includes a second impeller with a hub and a plurality of blades disposed around the hub and axially arranged with the first impeller in series, and a second housing for receiving the second impeller therein. The second housing can be assembled with the first housing by screwing, engaging, riveting or adhering. Alternatively, the second housing is integrally formed with the first housing as a monolith piece by injection molding.

The present invention may best be understood through the following description with reference to the accompanying drawings, in which:

DETAILED DESCRIPTION OF THE PREFERRED EMBODIMENT

The present invention will now be described more detailedly with reference to the following embodiments. It is to be noted that the following descriptions of the preferred embodiments of this invention are presented herein for the purpose of illustration and description only. It is not intended to be exhaustive or to be limited to the precise form disclosed.

Figure 2:
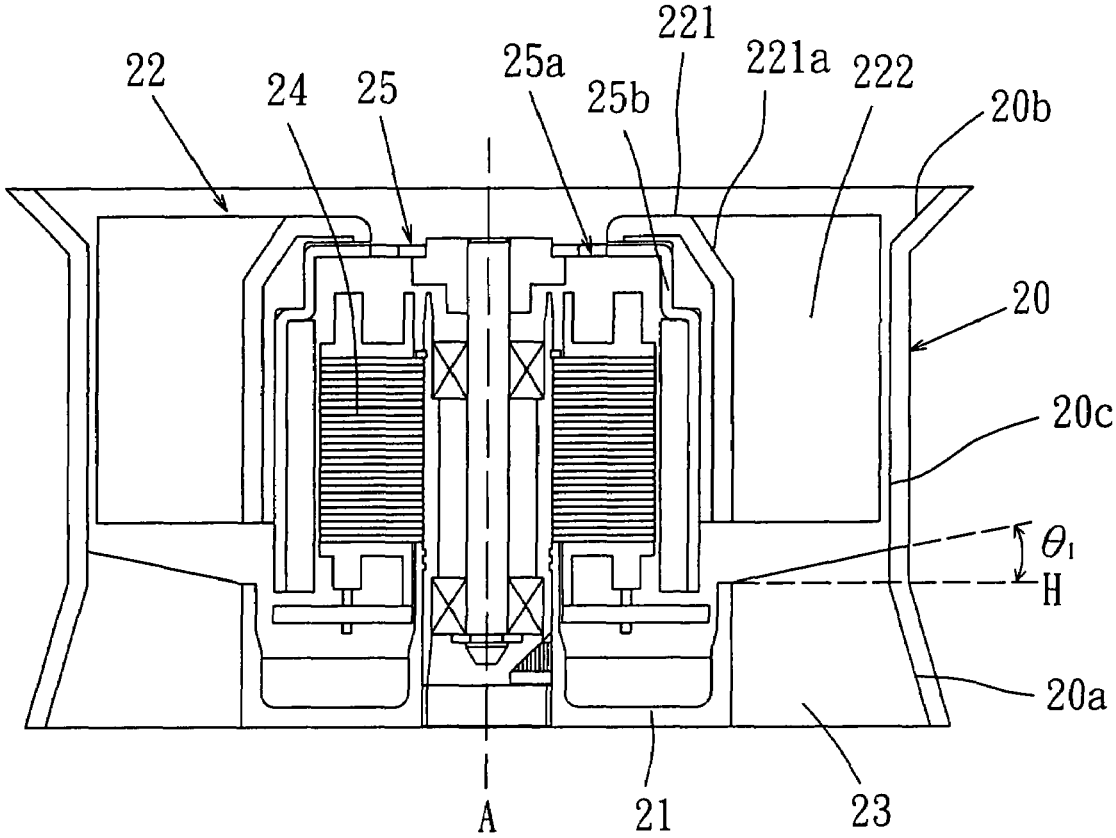
FIG. 2 is a sectional view of the first preferred embodiment of the heat-dissipating fan of the present invention.

First of all, please refer to FIG. 2 which shows the first preferred embodiment of the heat-dissipating fan of the present invention. The heat-dissipating fan includes a housing 20, a base 21 mounted inside the housing 20 for supporting a driving device or motor 24 used for driving the heat-dissipating fan to rotate, and an air-guiding member 23 disposed between the base 21 and the housing 20 and positioned at the air outlet side or the air inlet side of the heat-dissipating fan.

The heat-dissipating fan further includes an impeller 22 having a hub 221 and a plurality of blades 222 arranged around the hub 221. The hub 221 has an inclined structure 221*a* located on a periphery of a top portion thereof for smoothly guiding more airflow toward the blades 222. Except that the housing 20 can be shaped as a square structure as shown in FIG. 2, it can also be shaped as a rectangle or circular profile. The housing 20, the base 21 and the air-guiding member 23 can be integrally formed as a monolithic piece by injection molding, using a plastic, metal or other similar material.

The heat-dissipating fan further includes a metallic shell 25 telescoped inside the hub 221, which has a stepped structure 25*b* on its upper edge corresponding to the position of the inclined structure 221*a* of the hub. The driving device 24 can be mounted inside the hub and the metallic shell for reducing the occupied space. In addition, the metallic shell 25 has a plurality of openings 25*a* formed on a top thereof for effectively dissipating the heat generated inside the fan while operating.

The housing 20 has an outwardly expanding part 20*a* located at the air outlet side of the fan and another outwardly expanding part 20*b* located at the air inlet side of the fan for increasing the intake and discharge airflow and smoothly guiding the airflow toward the impeller.

The air-guiding member 23 can be composed of a plurality of ribs or stationary blades connected between the outwardly expanding part 20*a* and the base 21. However, the arrangement of the air-guiding members 23 can be varied or modified according to the actual application. For example, one end of the air-guiding member 23 is connected to the base 21 and the other end thereof is free and extended toward the outwardly expanding part 20*a*; alternatively, one end of the air-guiding member 23 is connected to the outwardly expanding part 20*a* and the other end thereof is free and extended toward the base 21; alternatively, some of ribs or stationary blades respectively have the ends connected to the base 21 and the opposite end thereof free extended toward a direction of the outwardly expanding part 20*a*, but others respectively have the ends connected to the outwardly expanding part 20*a* and the opposite end thereof free extended toward a direction of the base 21. In addition, the cross-section area of the air-guiding member 23 can be constant, or gradually increased or decreased in a direction from the base 21 toward the outwardly expanding part 20*a*. Alternatively, the air-guiding member 23 can be shaped as an inside recessing or outside jutting configuration, that is to say, the thickness of a central portion of the air-guiding member 23 is relatively greater or smaller than those of two opposite ends thereof.

As shown in FIG. 2, the upper edge of the air-guiding member 23 on the windward side has an inclined angle $\theta_1$ relative to a horizontal line H perpendicular to an axis A of the fan. The inclined angle $\theta_1$ is preferably ranged from 3° to 45°. Because there is an inclined angle $\theta_1$ between the upper edge and the horizontal line H, it can separate the arriving time of the airflow generated by the rotation of the impeller to the air-guiding member 23, thereby eliminating the noise caused by the air turbulence.

Figure 3:
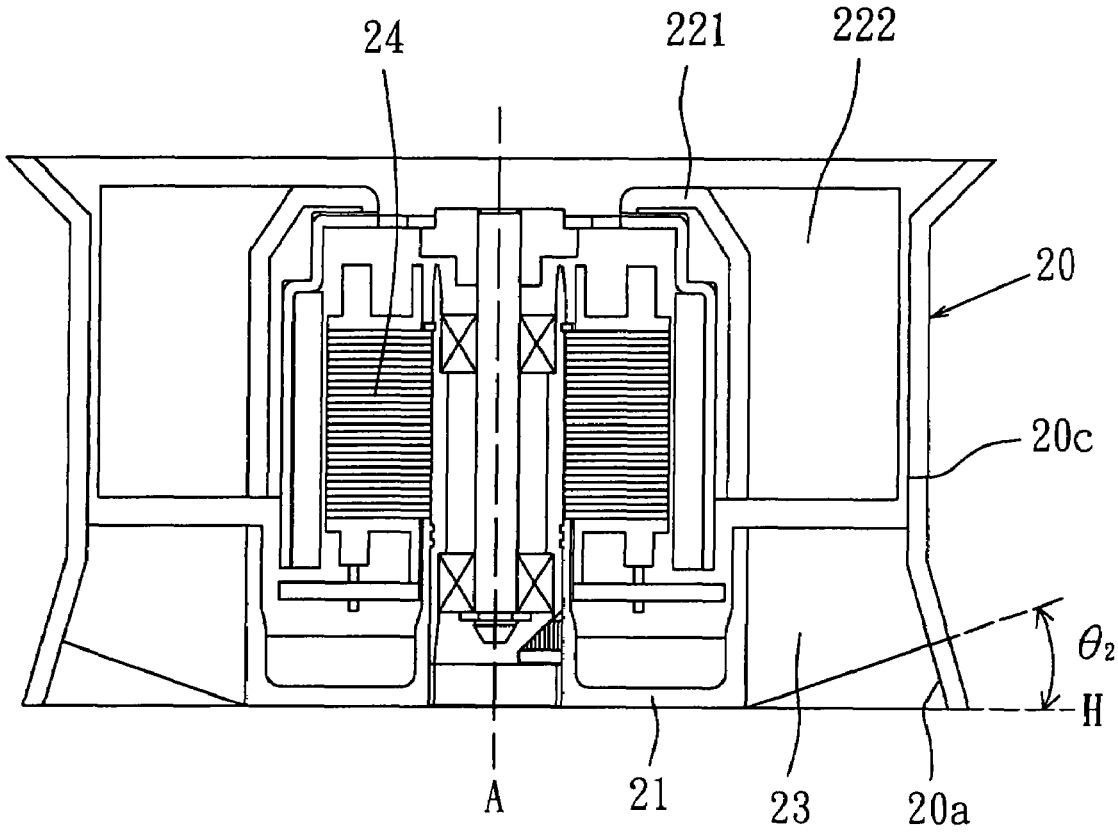
FIG. 3 is a sectional view of the second preferred embodiment of the heat-dissipating fan of the present invention.

Now, please refer to FIG. 3 showing the second preferred embodiment of the heat-dissipating fan of the present invention. Its structure is substantially similar to that of the first preferred embodiment except that the upper edge of the air-guiding member 23 is in a horizontal manner and there is an inclined angle $\theta_2$ between its lower edge and the horizontal line H in this embodiment. The inclined angle $\theta_2$ is preferably ranged from 3° to 45°.

Figure 4:
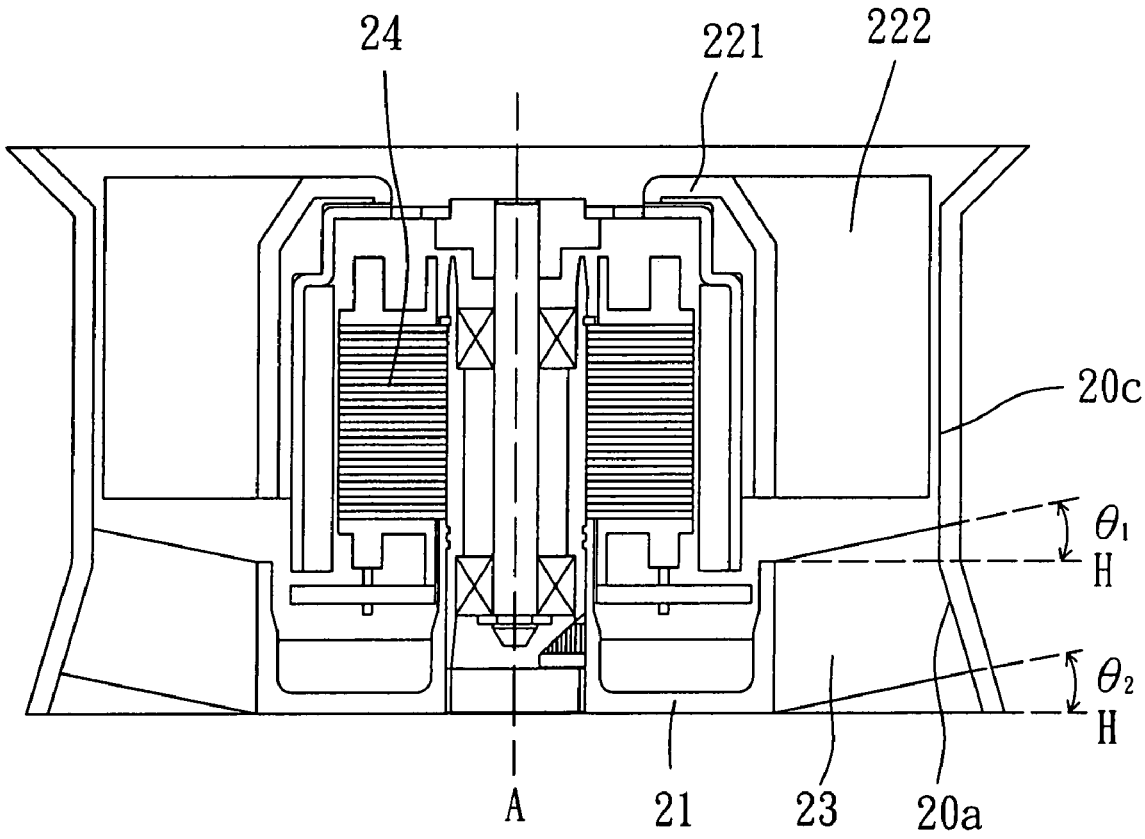
FIG. 4 is a sectional view of the third preferred embodiment of the heat-dissipating fan of the present invention.

Please refer to FIG. 4 showing the third preferred embodiment of the heat-dissipating fan of the present invention. Its structure is substantially similar to that of the first preferred embodiment. The difference is that there is an inclined angle $\theta_1$ between the upper edge of the air-guiding member 23 and the horizontal line H and there is also an inclined angle $\theta_2$ between its lower edge and the horizontal line H in this embodiment. The inclined angle $\theta_1$ can be greater than, equal to, or smaller than the inclined angle $\theta_2$.

Figure 5:
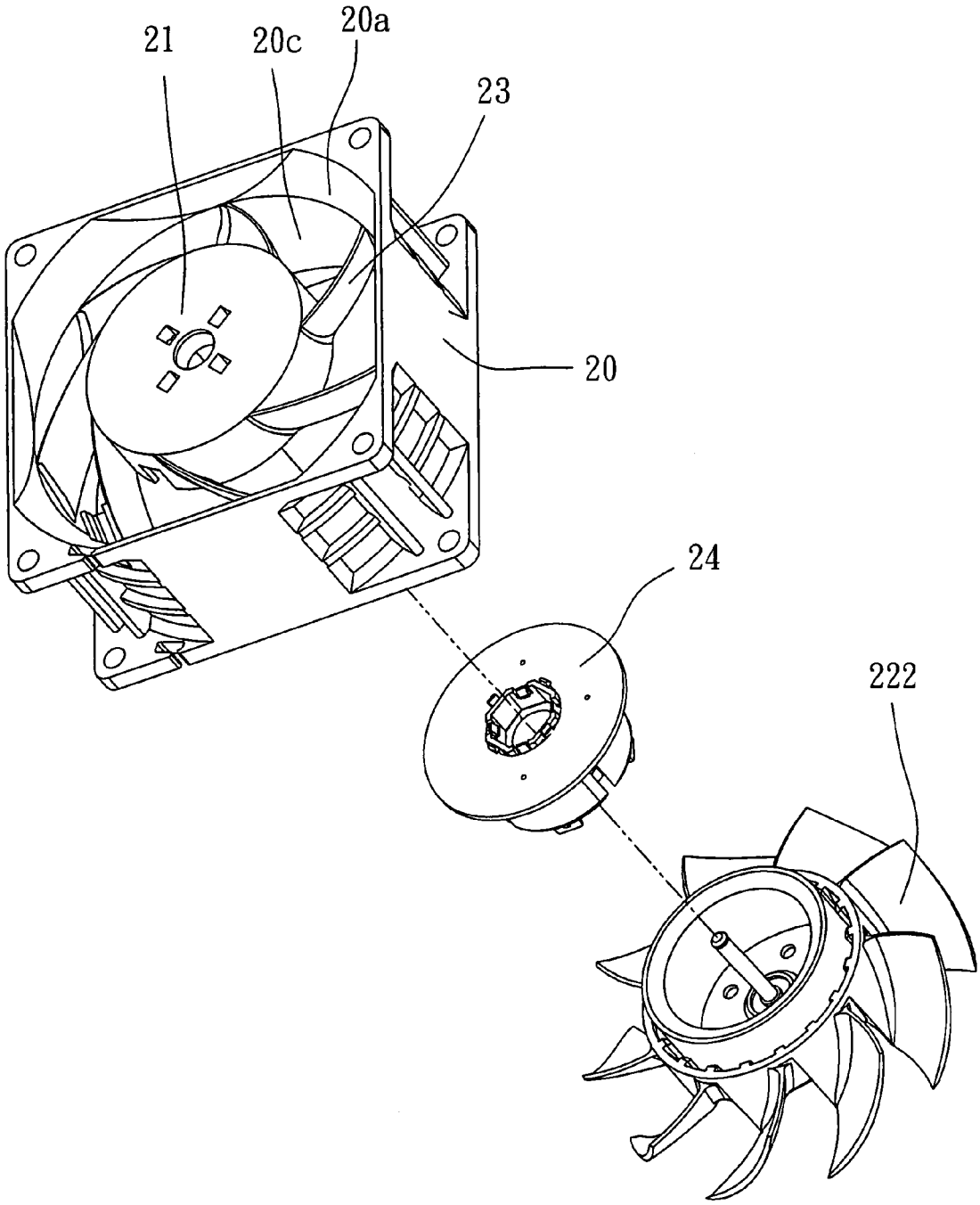
FIG. 5 is an exploded view of the fourth preferred embodiment of the heat-dissipating fan of the present invention.

Please refer to FIG. 5 showing the fourth preferred embodiment of the heat-dissipating fan of the present invention. Its structure is substantially similar to that of the third preferred embodiment except that one end of the air-guiding member 23 is fixed onto the base 21 and the other end of the air-guiding member 23 is fixed onto the inner wall of the cylindrical part 20*c* of the housing 20 in this embodiment, but in the third embodiment, one end of the air-guiding member 23 is fixed onto the base 21 and the other end of the air-guiding member 23 is simultaneously connected to the inner wall of the cylindrical part 20*c* of the housing 20 and the inner wall of the outwardly expanding part 20*a*. In this embodiment, the number of blades of the impeller is greater than that of the air-guiding members. The air-guiding member can have a stick, curved, trapezoid or wing-like cross-section shape and the blades have a curved or wing-like cross-section with an inclined angle, preferably ranging from 15° to 60°, relative to the axis of the fan.

Figure 6:
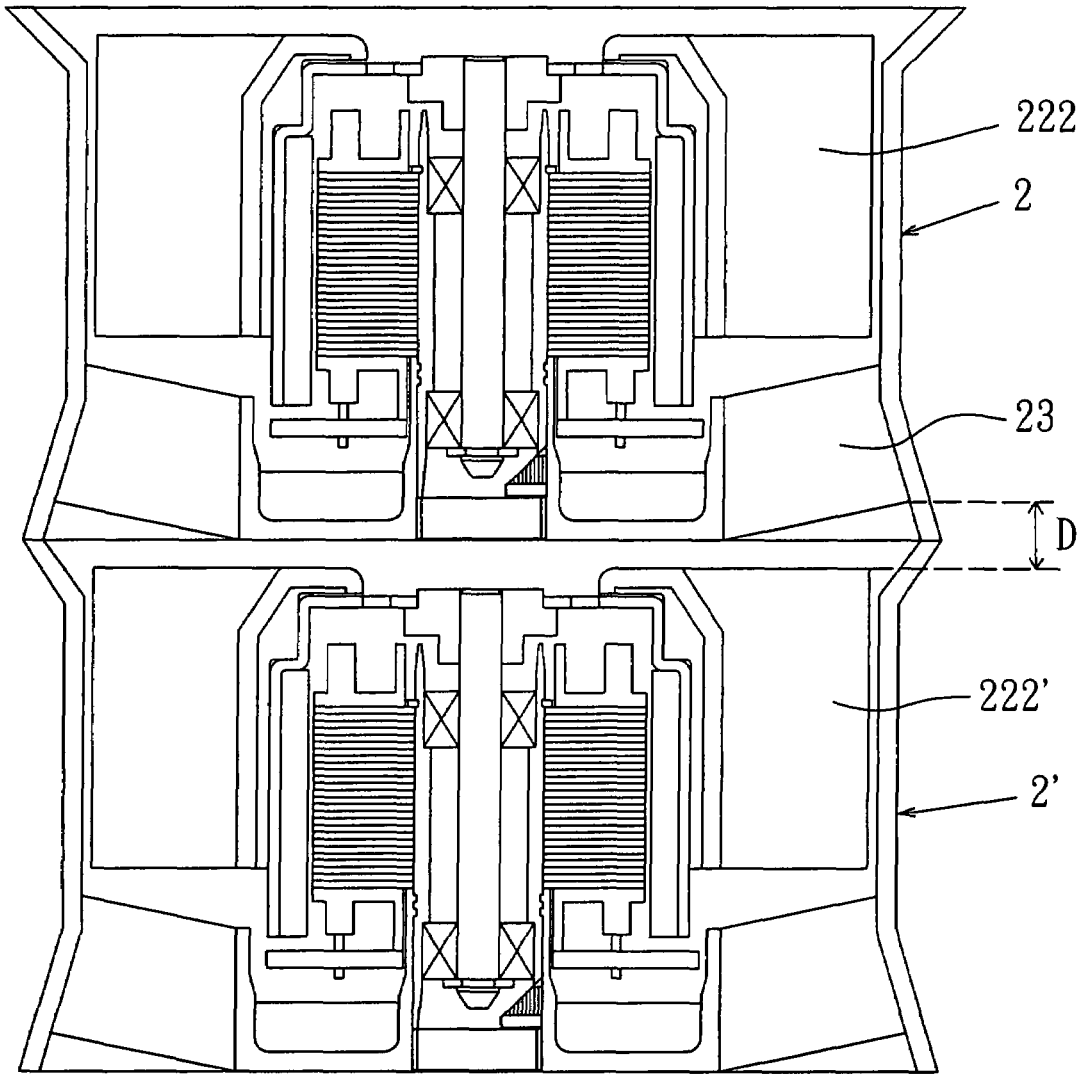
FIG. 6 is a sectional view of the fifth preferred embodiment of the heat-dissipating fan of the present invention.

In addition, please refer to FIG. 6 showing the fifth preferred embodiment of the heat-dissipating fan of the present invention. Its structure is the combination of two heat-dissipating fans, like that shown in FIG. 4, arranged in series in the axial direction. Because the lower edge of the air-guiding member 23 is extended upward in the first fan 2, the distance D between the lower edge of the air-guiding member 23 of the first fan 2 and the upper edge of the blades 222' of the second impeller is not uniform, thereby effectively reducing the noise. The housing of the first fan 2 and the housing of the second fan 2' can be assembled together by screwing, engaging, riveting or adhering ways. Alternatively, both of them can be integrally formed as a single piece for receiving two impellers 222, 222' therein by injection molding.

Figure 7:
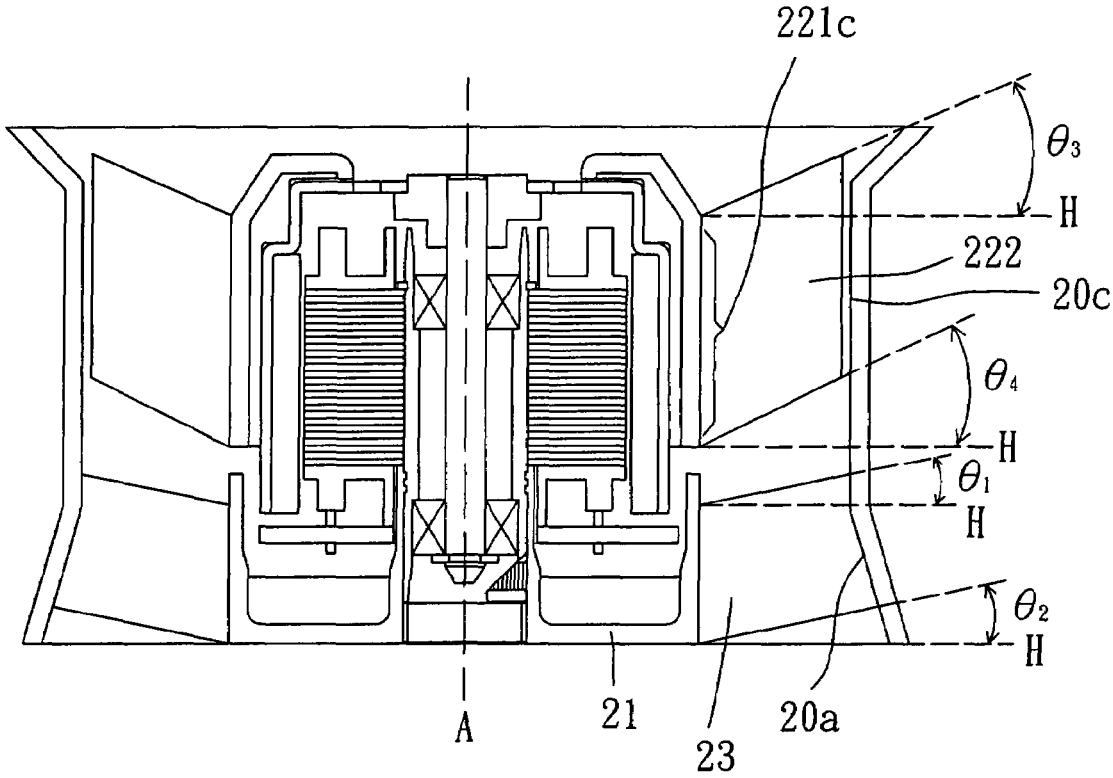
FIG. 7 is a sectional view of the sixth preferred embodiment of the heat-dissipating fan of the present invention.

Please refer to FIG. 7 showing the sixth preferred embodiment of the heat-dissipating fan of the present invention. Its structure is substantially similar to that of the third preferred embodiment of FIG. 4 except that both of the upper and lower edges of the impeller 222 are extended upwardly. There is an inclined angle $\theta_3$ between the upper edge of the impeller 222 and the horizontal line H and there is also an inclined angle $\theta_4$ between the lower edge of the impeller 222 and the horizontal line H in this embodiment. The inclined angle $\theta_3$ and $\theta_4$ are preferably ranged from 3° to 45°. The inclined angle $\theta_3$ can be greater than, equal to, or smaller than the inclined angle $\theta_4$. Alternatively, the inclined angles $\theta_1$, $\theta_2$, $\theta_3$ and $\theta_4$ are unequal. Such a design can separate the arriving time of the air contacting the air-guiding member 23, thereby eliminating the noise caused by the air turbulence and improving the sound quality. In addition, the upper inner edge of the impeller is positioned at an interface between the inclined structure and the vertical portion 221*c* of the hub.

Figure 8:
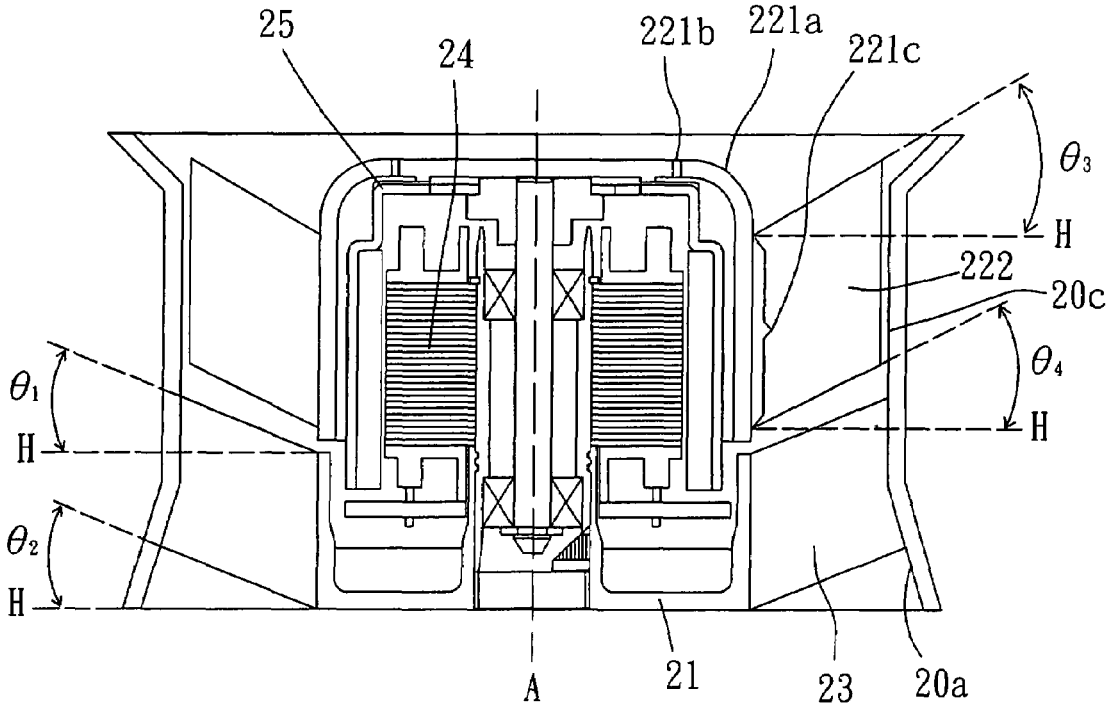
FIG. 8 is a sectional view of the seventh preferred embodiment of the heat-dissipating fan of the present invention.

Finally, please refer to FIG. 8 showing the seventh preferred embodiment of the heat-dissipating fan of the present invention. Its structure is substantially similar to that of the sixth preferred embodiment of FIG. 7. Their differences are that the metallic shell 25 is telescoped to the hub 221 and completely disposed inside the hub instead of being exposed outside, and the hub 221 includes three portions—the top portion has a plurality of through holes 221*b* for dissipating the heat, generated from the internal components while operating and passing through the openings 25*a* formed on the metallic shell, to outside; the arc structure 221*a* (that is so-called R angle) is formed on the periphery of the top portion; and the vertical portion 221*c* is connected with the blades 222 of the impeller, in which the upper inner edge of the blade is positioned on the interface between the vertical portion 221*c* and the arc structure 221*a* for eliminating the noise generation, and the lower inner edge of each blade is slightly higher than the bottom end of the vertical portion 221*c* for reducing the occurrence of deckle edge. In addition, the inclined angle $\theta_3$ of the upper edge of the blade 222 can be unequal to the inclined angle $\theta_4$ of the lower edge of the blade 222.

In the above-described embodiments, one end of the air-guiding member 23 is connected to the base 21 and the other end is fixed onto the inner wall of the cylindrical part 20*c*. Alternatively, one end of the air-guiding member 23 can be connected to the base 21 and the other end can be simultaneously connected to the inner wall of the cylindrical part 20*c* and the inner wall of the outwardly expanding part 20*a*. In addition, the upper and lower edges of the air-guiding member 23 can be but not limited to be inclined at the same time. It can be optionally modified according to the actual application.

Figure 1:
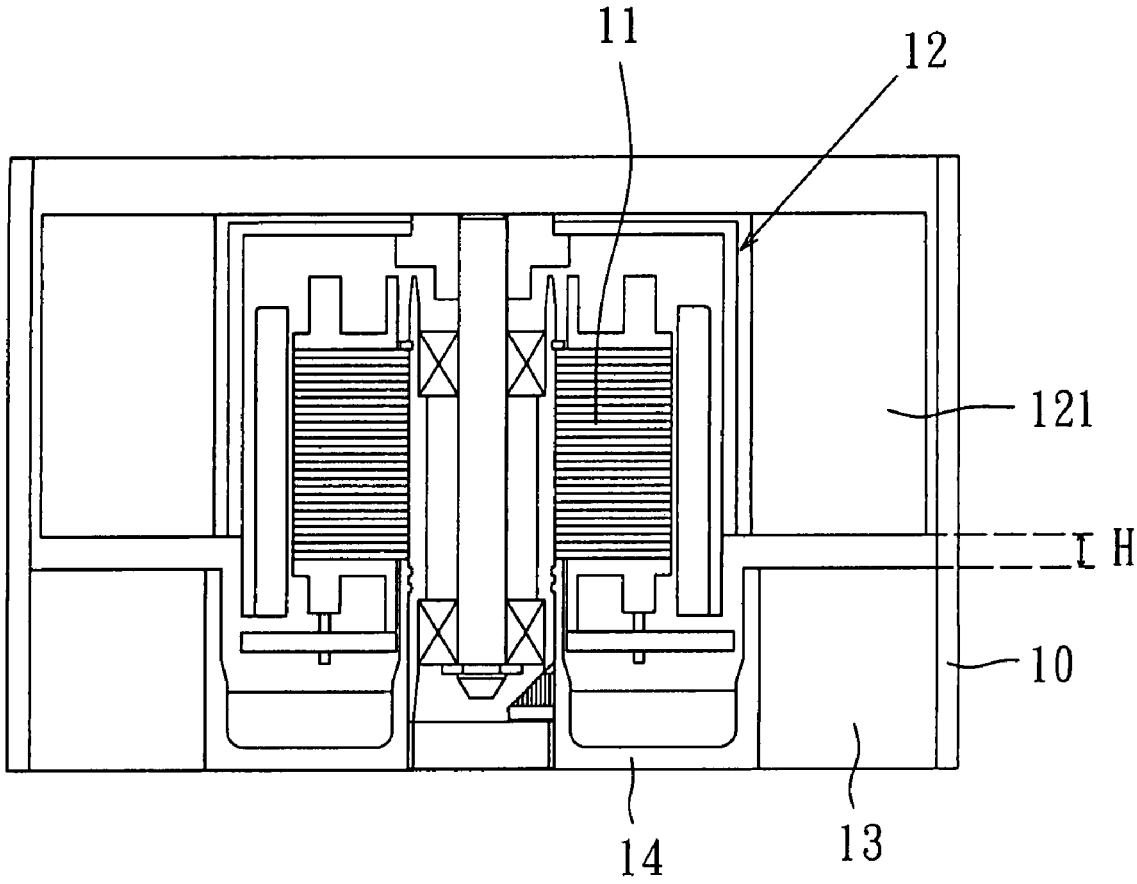
Fig. 1(Prior Art)
FIG. 1 is a sectional view of a conventional axial-flow fan.
Figure 9:
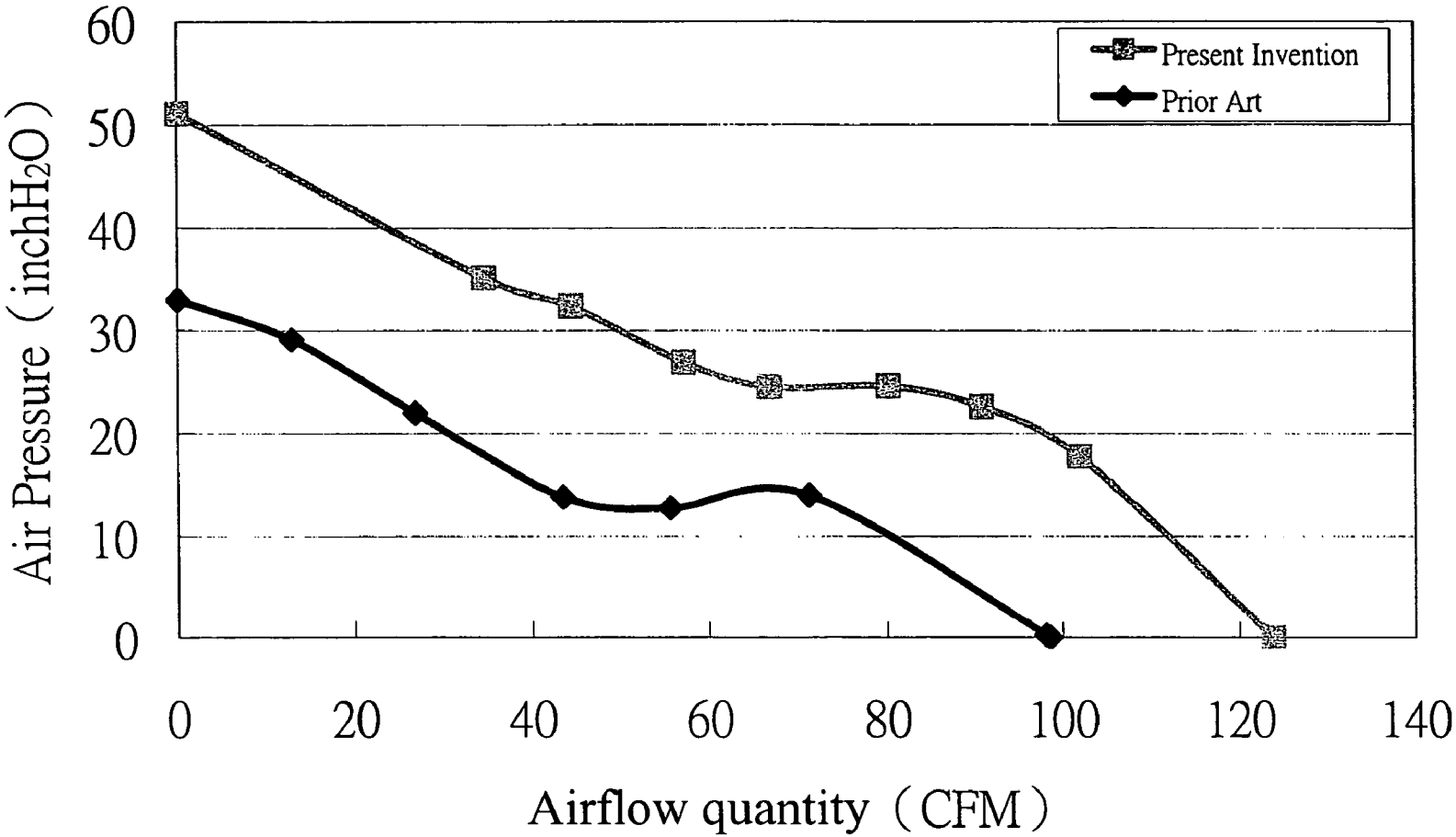
FIG. 9 shows the performance comparison of the air pressure and the airflow quantity between the conventional axial-flow fan and the present invention.

Finally, please refer to FIG. 9 showing the performance comparison of the air pressure and the airflow quantity between the conventional axial-flow fan of FIG. 1 and the present invention. From this figure, it is clearly indicated that not only can the upward-design air-guiding member 23 effectively increase the air pressure and the airflow quantity but greatly reduce the noise of air turbulence. For example, at the same rotation speed of 7500 rpm, the heat-dissipating fan with the upward-design air-guiding member 23 can decrease at least 5 dBA in comparison with the prior art.

In conclusion, the present invention provides a heat-dissipating fan and its housing with an upward air-guiding member which can greatly reduce the noise of air turbulence and increase the air pressure and quantity so as to enhance its whole heat dissipation efficiency.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A heat-dissipating fan comprising:

a first housing having an outwardly expanding part and a cylindrical part;

a first impeller having a hub and a plurality of blades arranged around the hub;

a base disposed inside the housing for supporting the first impeller; and an air-guiding member disposed between the outwardly expanding part and the base, having a first edge with a first inclined angle relative to a line perpendicular to an axis of the heat-dissipating fan, wherein the first housing, the base and the air-guiding member are integrally formed to be a single piece and the air-guiding member has one end connected to the base and the other end connected to inner walls of the cylindrical part and the outwardly expanding part.

2. The heat-dissipating fan according to claim 1, wherein the air-guiding member has a second edge located opposite to the first edge and having a second inclined angle relative to the line.

3. The heat-dissipating fan according to claim 2, wherein the first or second inclined angle is ranged from 3° to 45°.

4. The heat-dissipating fan according to claim 2, wherein at least one blade of the impeller has an edge with a third inclined angle relative to the line.

5. The heat-dissipating fan according to claim 4, wherein at least one blade of the impeller has an opposite edge with a fourth inclined angle relative to the line.

6. The heat-dissipating fan according to claim 5, wherein the third or fourth inclined angle is ranged from 3° to 45°.

7. The heat-dissipating fan according to claim 5, wherein the first inclined angle is relatively greater than or less than the second inclined angle, and the third inclined angle is relatively greater than or less than the fourth inclined angle.

8. The heat-dissipating fan according to claim 1, wherein the air-guiding member is positioned on an air inlet or an air outlet of the heat-dissipating fan.

9. The heat-dissipating fan according to claim 1, wherein the air-guiding member has a central part with a thickness relatively greater or smaller than those of two opposite ends thereof.

10. The heat-dissipating fan according to claim 1, wherein the blades have a curved or wing-like cross-section with an inclined angle ranging from 15° to 60° relative to the axis of the heat-dissipating fan.

11. The heat-dissipating fan according to claim 1, further comprising a driving device mounted inside the hub for driving the first impeller.

12. The heat-dissipating fan according to claim 1, wherein the blades of the first impeller respectively have an upper inner edge positioned at an interface between an inclined or arc structure and a vertical portion of the hub.

13. The heat-dissipating fan according to claim 1, wherein the blades of the first impeller respectively have a lower inner edge relatively higher than a bottom end of a vertical portion of the hub.

14. The heat-dissipating fan according to claim 1, wherein the first housing includes a cylindrical part and the air-guiding member has one end connected to the base and the other end connected to an inner wall of the cylindrical part.

15. The heat-dissipating fan according to claim 1, further comprising a second impeller with a hub and a plurality of blades disposed around the hub and axially arranged with the first impeller in series.

16. The heat-dissipating fan according to claim 15, further comprising a second housing for receiving the second impeller therein.

17. The heat-dissipating fan according to claim 15, wherein the second housing is assembled with the first housing by screwing, engaging, riveting or adhering.

18. The heat-dissipating fan according to claim 15, wherein the second housing is integrally formed with the first housing as a monolith piece by injection molding.

19. A heat-dissipating fan comprising:

a first housing having an outwardly expanding part;

a first impeller having a hub and a plurality of blades arranged around the hub;

a base disposed inside the housing for supporting the first impeller; and an air-guiding member disposed between the outwardly expanding part and the base, having a first edge with a first inclined angle relative to a line perpendicular to an axis of the heat-dissipating fan, and having a gradually increasing or decreasing cross-section area from the base toward the first housing, wherein the first housing, the base and the air-guiding member are integrally formed to be a single piece.

* * * * *

UNITED STATES PATENT AND TRADEMARK OFFICE

CERTIFICATE OF CORRECTION

PATENT NO. : 7,726,939 B2
APPLICATION NO. : 11/822500
DATED : June 1, 2010
INVENTOR(S) : Chin-Hung Lee et al.

It is certified that error appears in the above-identified patent and that said Letters Patent is hereby corrected as shown below:

ON THE TITLE PAGE:

Insert the following as item (30), Foreign Application Priority Data:

-- (30) Foreign Application Priority Data

Aug. 27, 2004 (TW) ..... 093125858 --.

Signed and Sealed this
Eleventh Day of January, 2011

David J. Kappos

David J. Kappos
*Director of the United States Patent and Trademark Office*